United States Patent [19]

Hickey

[11] Patent Number: 4,992,145

[45] Date of Patent: Feb. 12, 1991

[54] ELECTROPLATING OF PRECISION PARTS

[75] Inventor: John C. Hickey, Ypsilanti, Mich.

[73] Assignee: Ford Motor Company, Dearborn, Mich.

[21] Appl. No.: 534,219

[22] Filed: Jun. 7, 1990

Related U.S. Application Data

[62] Division of Ser. No. 457,676, Dec. 27, 1989, Pat. No. 4,946,572.

[51] Int. Cl.[5] ..... C25D 5/34; C25D 5/48

[52] U.S. Cl. ..... 204/23; 204/32.1; 204/35.1

[58] Field of Search ..... 204/23, 32.1, 35.1; 239/96

[56] References Cited

U.S. PATENT DOCUMENTS

| | | | |
|---|---|---|---|
| 3,823,074 | 7/1974 | Minbiole | 204/23 |
| 4,253,916 | 3/1981 | Kobayashi | 204/23 |
| 4,671,862 | 6/1987 | Birkle et al. | 204/213 |
| 4,696,728 | 9/1987 | Birkle et al. | 204/213 |

*Primary Examiner*—T. M. Tufariello

*Attorney, Agent, or Firm*—Joseph W. Malleck; Roger L. May

[57] ABSTRACT

An apparatus assembly for use in an electroplating cell having an electrolyte and one or more sacrificial anodes, comprising: an electrically conductive magazine (elongated steel ribs) defining a sliding supportive track for electrically conductive articles to be coated, said magazine being supported for turning about an axis generally perpendicular to said track, said magazine providing freedom for sliding movement of such articles along said track to either side of said axis during each half-revolution of the magazine about the axis; means for establishing a current throw through said electrolyte between said anode and articles along planes generally parallel to said axis; and means for rotatably driving said magazine about said axis so that each of said articles will experience electrolyte flow reversal and a generally equal length path of movement through said electrolyte for each revolution of the magazine about said axis.

A method of electroplating a precision hollow article using the sliding, shifting action of such magazine, and an electroplated fuel injector housing resulting from using such apparatus and method.

6 Claims, 6 Drawing Sheets

ELECTROPLATING OF PRECISION PARTS

This is a division of application Ser. No. 457,676, filed Dec. 27, 1989, now U.S. Pat. No. 4,946,572.

BACKGROUND OF THE INVENTION

1. Technical Field

This invention relates to the art of electroplating, and more particularly to electrodepositing precisely uniform anticorrosive coatings onto flux permeable housings for subminiature electromagnetic metering devices.

2. Discussion of the Prior Art

Commercial mass electroplating of precision and nonprecision parts has heretofore been carried out by essentially two techniques: stationary rack electroplating, and rotating barrel electroplating. Stational rack plating involves immersion of conductive articles, supported on a cathodically connected rack into an electrolyte in which is also immersed sacrificial anodes spaced from the rack. The rack is held stationary within the electrolyte in a preferred orientation to the directionality of the galvanic field. Absolute uniformity of coating throughout all of the Parts is extremely difficult if not impossible in this type of plating because of the directionality of the galvanic field and the presence of surfaces hidden from the galvanic field. Thus, stationary rack plating is unsuited to the deposit of precisely uniform coatings throughout the interior as well as exterior of subminiature articles, such as automotive fuel injector devices.

Barrel plating is generally used for goods that are too small for racking or for economical bulk plating of large volumes of parts (even variably sized parts). Unfortunately, barrel plating inherently requires tumbling of the goods within the barrel to obtain reorientation of each part with respect to the direction of the galvanic field. This tumbling action inhibits attaining an absolutely uniform, microthin coating throughout the plated surfaces of small parts because the impact of one good against the other will lead to void spots or damage to the goods by tumbling impact (see U.S. Pat. Nos. 4,696,728 and 4,671,862). Such impact should be distinguished from sliding motion, the importance of which will become apparent later in the description of this inventive application. Impacting is the exchange of forces at an angle to the surface contacted, whereas sliding is a contact generally parallel to the surface being contacted and involves forces far less than impacting.

What is needed is a method and apparatus that will allow large quantities of hollow precision parts to be electroplated with virtual perfect uniformity in microthin thickness (i.e., 0.0003–0.0005 inches) internally as well as externally. To achieve such goal, the method must create a flow reversal of the electrolyte during the plating cycle with respect to the article plated and must generate a variable path for the article being coated so that each experiences nearness and remoteness from the sacrificial anodes during plating.

SUMMARY OF THE INVENTION

The apparatus aspect of this invention is an assembly for use with an electroplating cell having an electrolyte and one or more sacrificial anodes. The apparatus comprises: (a) an electrically conductive magazine defining a sliding supportive track for electrically conductive articles to be coated, the magazine being supported for turning about an axis generally perpendicular to the track and the magazine providing freedom for sliding movement of such articles along such track to either side of said axis during each half-revolution of the magazine about the axis; (b) means for establishing a current throw through said electrolyte between said anode and articles along planes generally parallel to the axis; and (c) means for rotatably driving the magazine about the axis so that each of said articles will experience electrolyte flow reversal and a generally equal length movement path through the electrolyte for each revolution of the magazine about the axis.

Preferably, the magazine has sides defined by elongated conductive ribs, forming a cage for sliding movement, the ribs being arranged in number and location to provide a minimum of triangulated encapsulation. Advantageously, the magazines are arranged as radiating spokes about a rotatable sleeve axis, and preferably are layered together along said sleeve axis.

Preferably, the means for establishing a current throw through said electrolyte between the anode and articles comprises a rotatably driven conductive sleeve defining the axis of rotation and having an electrical connection to the magazine, a commutator within the sleeve, and an electrode dangler extending into and connected with the commutator to constitute said magazine as a cathode.

Preferably, the means for rotatably driving the magazine comprises a support frame having legs for suspending drive gearing and for suspending the driven sleeve defining the axis of rotation, the sleeve being nonconductively connected to said legs; a beam assembly extending across such legs while separated from the magazine movement and suspending the anode along a side of revolving path of the articles to be coated; electrode elements insulatingly supported by and extending along the frame for carrying current to the anode. Nonconductive gearing is used to impart turning of the sleeve about its axis.

The method mode of this invention is Particularly effective for electroplating a precision hollow metal article with anticorrosive films. The method comprises the steps of: (a) cleaning a surface of an article to be plated; and (b) subjecting the cleansed surface to one or more electrolytic cells provided with at least one sacrificial anode and galvanic field oriented along a predetermined plane, each article being rotated within such cell across the field while allowing the article to shift between a radially inner and a radially outer position relative to the axis during each revolution thereof.

Preferably, one of the electrolytic cells provides an anticorrosive metal, such as zinc, as the sacrificial anode material, and another of the electrolytic cells provides a chromate salt electrolyte to form a conversion coating on said anticorrosive metal coating.

Another aspect of this invention is an article of manufacture comprised of an electroplated fuel injection housing capable of successfully withstanding at least 96 hours of a salt spray test, such housing being particularly characterized by: (a) a stepped steel tube, one end of which is comprised of a barrel, the other end of which is comprised of a reduced neck, and a throat narrower than either said barrel or neck and joining the neck and barrel; (b) deformable annular lips about the exposed edges of said neck and barrel; and (c) electrolytically deposited, highly uniform layers of zinc and chromate throughout substantially all interior and exterior surfaces of the housing, the layers having a total thickness of 0.0003–0.0005 inches.

SUMMARY OF THE DRAWINGS

FIG. 6 is an enlarged perspective view of a portion of the magazine structure of FIG. 1;

DETAILED DESCRIPTION AND BEST MODE

Figure 1:
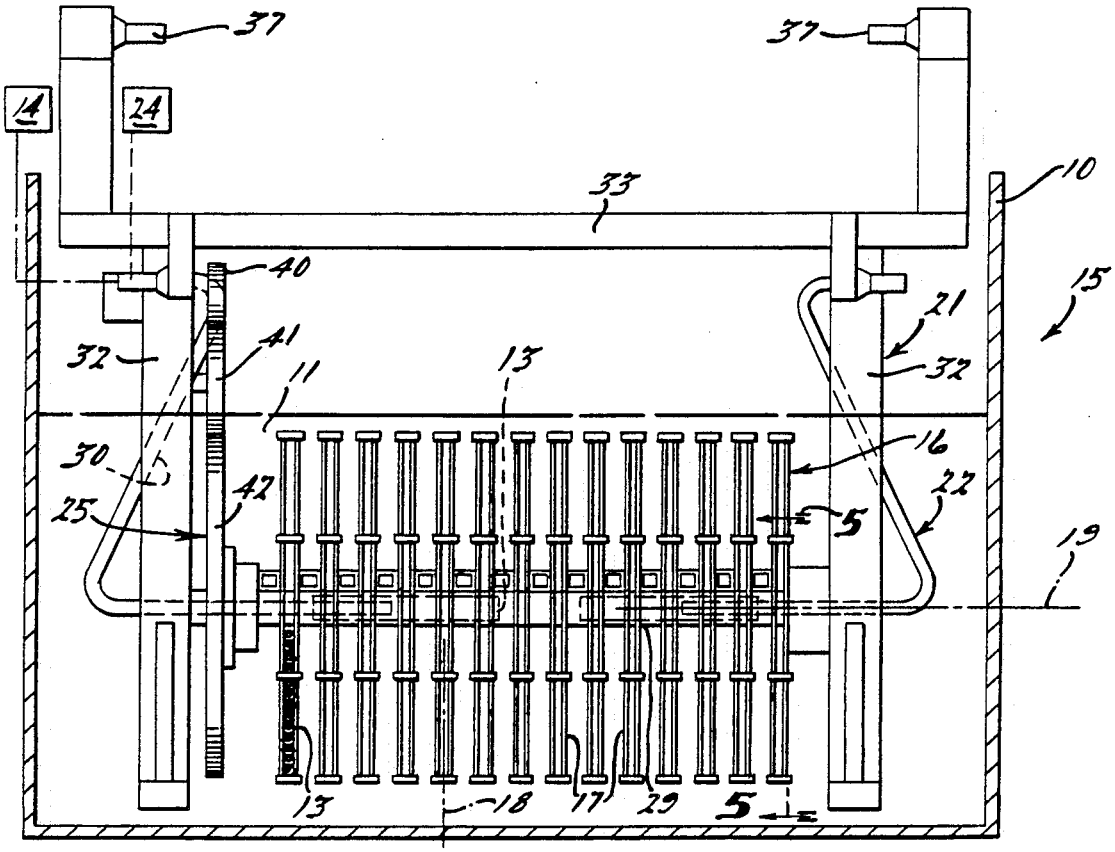
FIG. 1 is an elevational view of an electroplating cell illustrating the use of the unique magazine configuration of this invention.
Figure 2:
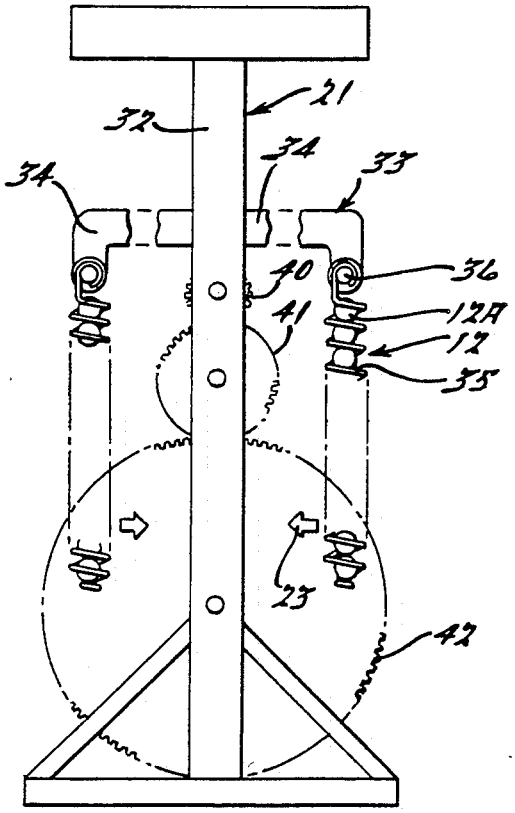
FIG. 2 is an end elevational view of the structure of FIG. 1.
Figure 3A:
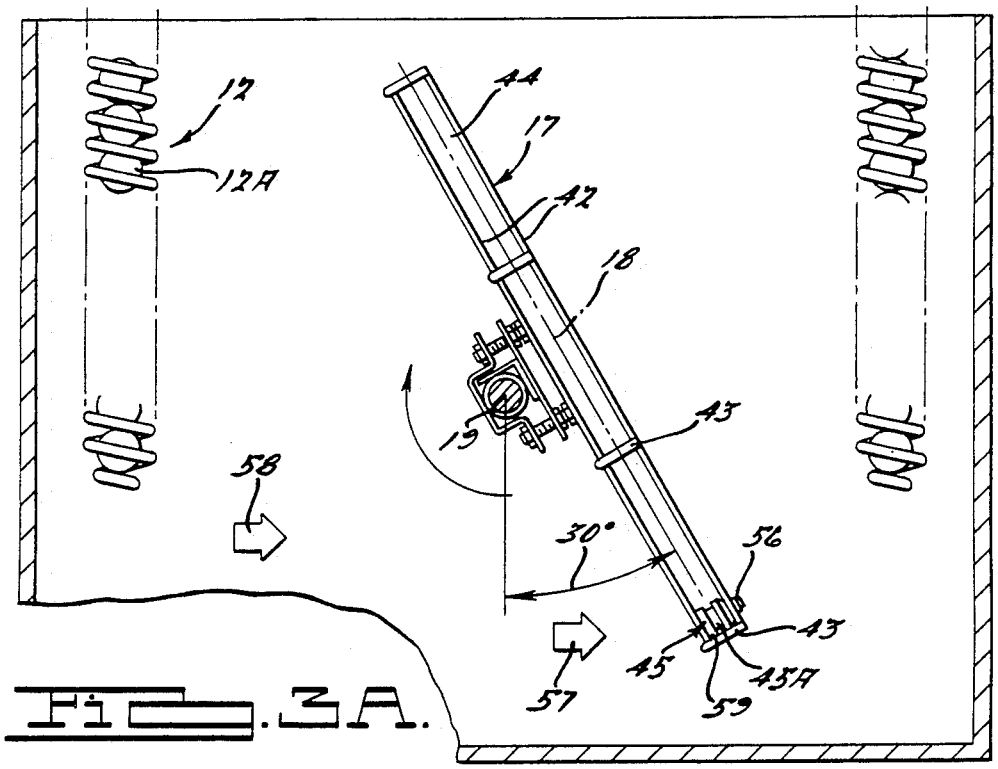
FIG. 3 is a sequence of views illustrating article movement during electroplating.
Figure 3B:
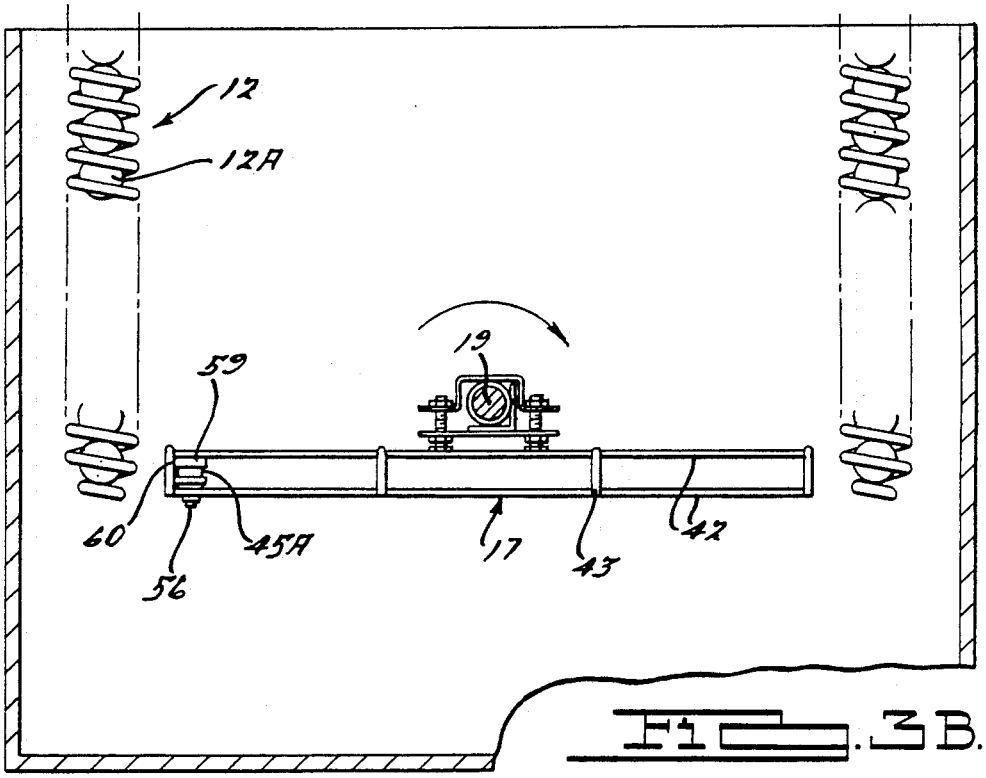
Figure 3C:
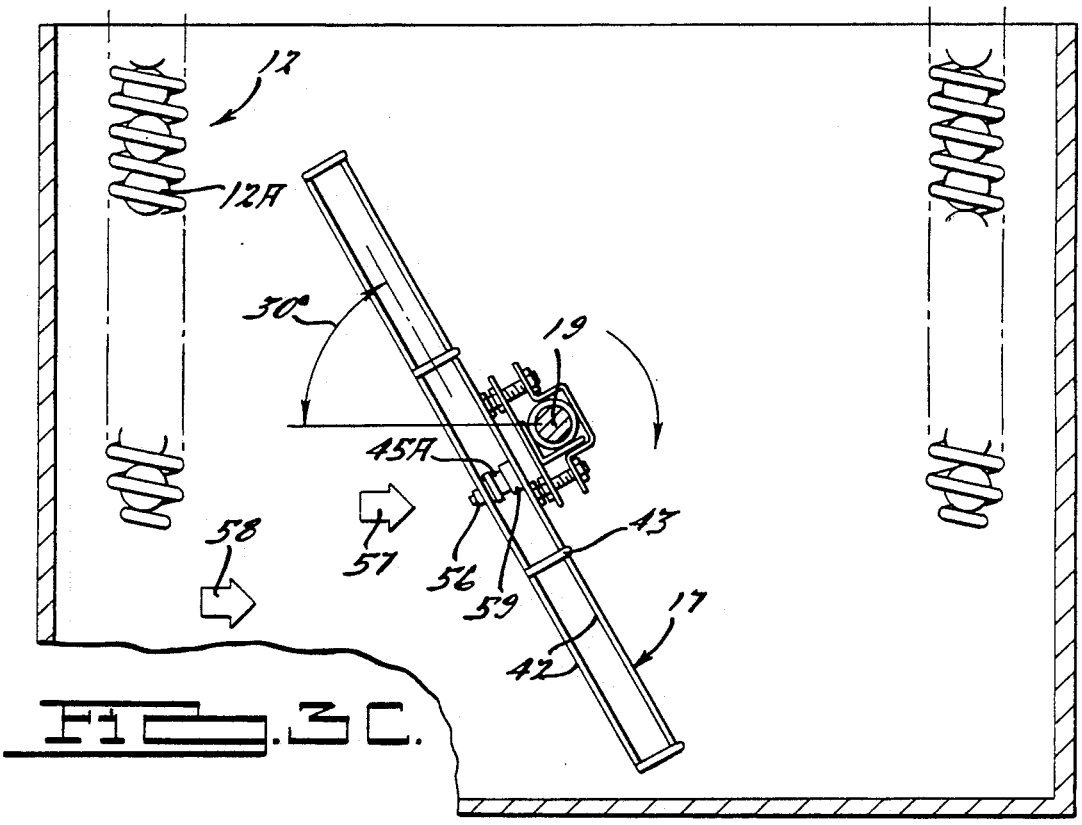
Figure 3D:
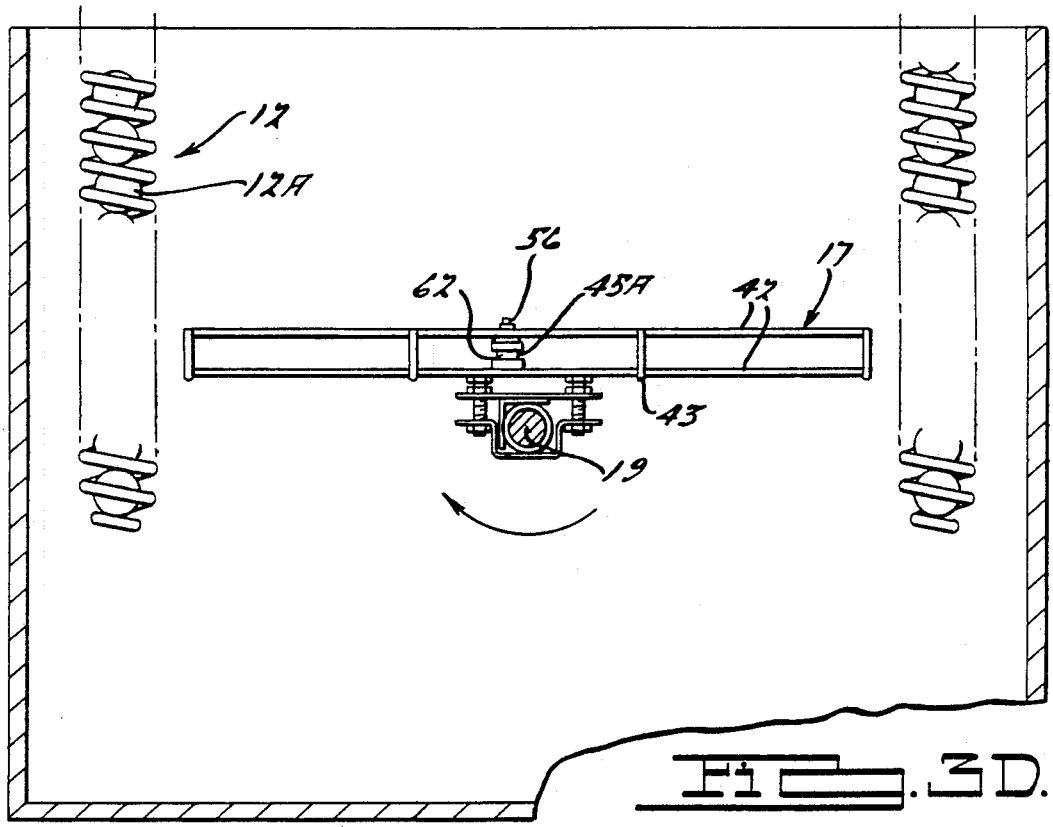

Referring to FIG. 1, the electrolytic cell 15 within which the apparatus 16 is used consists of a tank 10 for holding a large quantity of electrolyte 11, sacrificial anodes 12 carrying the conductive metal 12*a* to be coated, articles 13 to be coated, and electrical source means 14 to maintain the necessary electrical potential between the anodes 12 and cathodic articles 13 for generating a galvanic field 23 through the electrolyte 11.

The apparatus 16 of this invention comprises one or more electrically conductive magazines 17 (here a series of 14 magazines in a single plane, each defining a sliding supportive track 18 for electrically conductive articles 13 to be coated, the magazines 17 being supported for turning about an axis 19 generally perpendicular to the tracks 18 with freedom of each article to move to either side of the axis 19 in response to gravity during each half-revolution of the magazines about their axes. The apparatus further comprises an immersible support rack 21 having means 22 for establishing a current throw or galvanic field 23 through the electrolyte 11 between the anode 12 and the goods or articles 13, and along planes generally parallel to the axis 19. The immersible support rack further comprises means 25 for transmitting driving power from a remote mechanical source 24 for rotating the magazines about the axis 19 so that each article or good will experience reversal of electrolyte flow 57 (see FIG. 3) and a generally equal length path through the electrolyte (see FIG. 4) for each revolution of the magazine about the axis.

Means 22 cathodically connects articles 13 to a positive potential and comprises a conductive, rotatably driven sleeve 29 (coincident with axis 19) to which each magazine is attached alongside thereof, an electrode dangler 30 extending into the sleeve 29 and is effective to carry positive polarity current, and a commutator 31 within the sleeve 29 for conducting current between the rotatably fixed dangler 30 and the rotatable sleeve 29.

Rack 21 has a pair of mechanical handling fixtures 37 from which hang a pair of legs 32 for rotatably suspending opposite ends of the sleeve 29 which carries the magazines, the sleeve being electrically insulated from the legs. A beam assembly 33 extends outwardly horizontally from the legs 32 in spaced relationship to the rotating movement profile of the magazines.

To provide an anode assembly for the electrolytic cell, the beam assembly 33 has cross arms 34 for suspending, in an electrically insulated manner, perforate columns 35 within which is contained sacrificial anode material 12*a*, such as zinc balls. An electrode rod 36, connected to a negative potential, extends to the columns 35; the electrode rod is insulatingly supported between the legs 32 of the rack.

Means 25 for transmitting driving power comprises a series of meshed nonconductive gears 40, 41, 42 which receive rotatable drive from a power source 24 remote to the rack.

Figure 4:
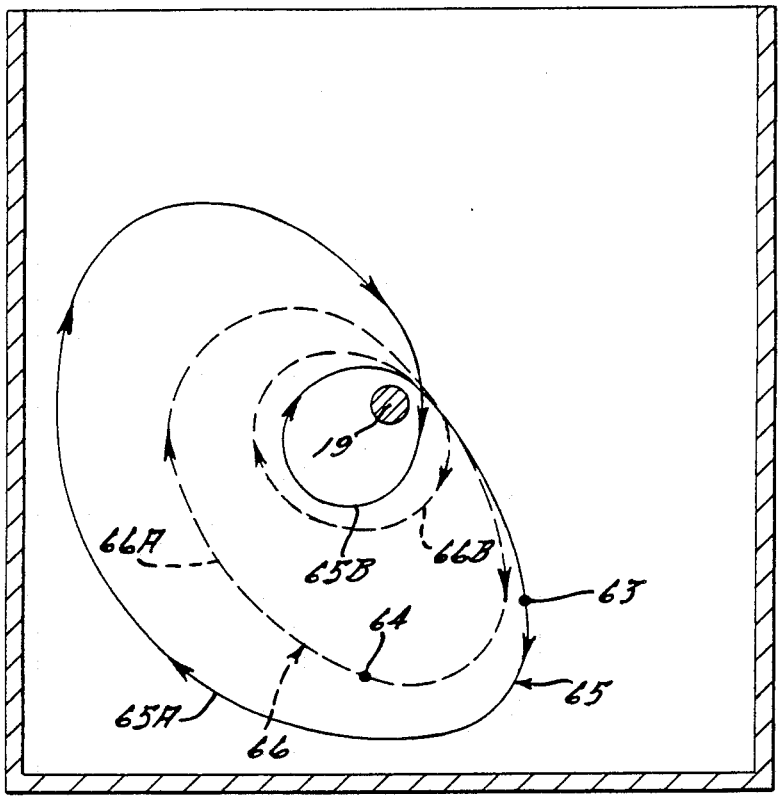
FIG. 4 is a path or trace of the center or reference points for two different articles at different loaded positions in the magazine and for one complete revolution of the magazine.
Figure 5:
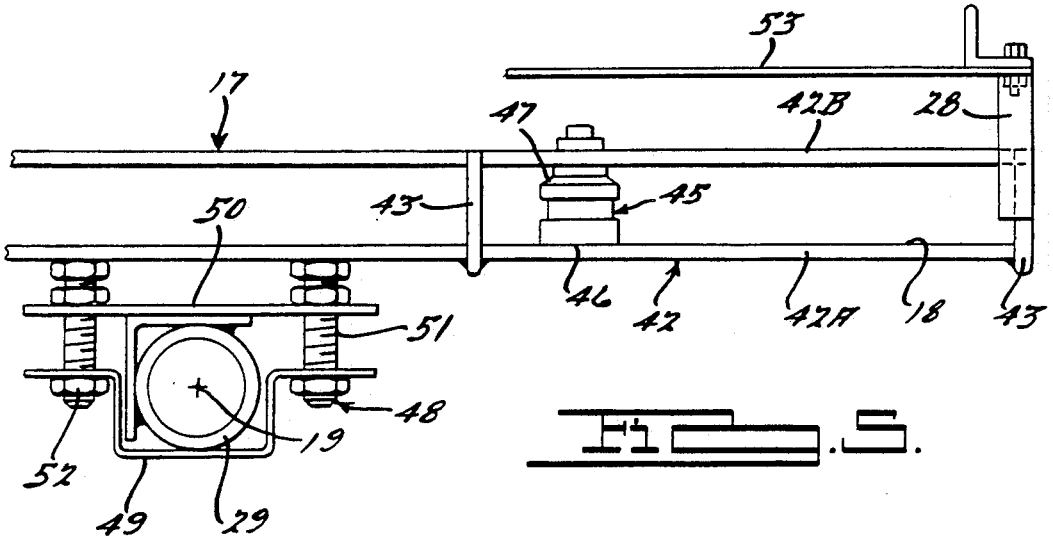
FIG. 5 is an enlarged fragmentary sectional view of a portion of the apparatus of FIG. 1 taken along line 5—5 thereof illustrating the mounting of a magazine on its sleeve axis for rotation.

As shown in FIGS. 3 and 4, each magazine 17 is constructed of conductive ribs 42 extending along and parallel to the direction of the track 18. The ribs are fixed in a desired cross-sectional configuration by collars 43 at each end and at intermediate locations to constitute a cage for the articles to slide along the track 18. The shape of the sliding space 44 is here designed to encapsulate fuel injection housings 45 which have a round as well as stepped elevational profile with a base edge 46 resting or riding on the bottom two ribs 42A, and with the annular shoulder 47 entrapped for sliding movement by the other two ribs 42B.

The magazine is attached to sleeve 29 (coincident with axis 19) by a conductive coupling 48 comprised of two clasps 49, 50, brought together by fasteners 51, 52 welded to the ribs 42A of the magazine. Imperforate masks 53, 29 may be deployed to shield the current throw from certain portions of the part to be electroplated and thereby further control deposition; the masks are nonconductively coated members supported at a desired spacing by fingers 28 secured to the magazine.

The straight ribs may be custom designed to suit the profile configuration of the article to be electroplated while promoting sliding motion and entrapment along the track. Conductive gates 54 can be used to close the ends of the tracks during rotation within the electrolyte.

Each article 13 being electroplated will experience flow reversal and an equal toroidal path through the electrolyte during its rotation. To illustrate how this works for the preferred embodiment, FIG. 3 shows a series of progressive positions 3A, 3B, 3C, 3D of one article 13 undergoing electroplating. The magazine is typically loaded with a supply (here about 11 in number) of fuel injector housings 45, each in conductive contact with the ribs 42 and with each other. We will focus on the outermost radial housing 45A (see view 3A) at the lowest position in the track 18. Gravity has pulled the entire series of housings down to the lowermost position within the track for the illustrated angular orientation of the magazine (about 30° from a perpendicular plane). As the magazine 17 rotates clockwise, the interior of the housing barrel 59 will be carried in a manner to experience electrolyte flow 57 thereinto and current throw 58 thereto as it moves arcuately but generally parallel to the plane of the current throw 58. As the magazine assumes a horizontal position (see view 3B), the exterior side 60 of the housing 45A is brought close to the left side anode 12 experiencing a stronger current field. Housing barrel 59 will be pointed upwardly and housing neck 56 will be pointed downwardly.

As the magazine rotates to an angular position of about 30° with a horizontal plane (see view 3C), the entire load or series of housings will slide downwardly and shift along track 18 to the other side of the magazine disposed on the opposite side of axis 19. In this position, housing 45A is now most adjacent to the axis 19 with its opposite end (housing neck 56) now exposed to the electrolyte flow 57 and with the hollow interior of neck 56 exposed to the current throw 58 as the article 45A moves along an arcuate swing, again generally parallel to such throw 58. When the magazine assumes again a generally horizontal position (see view 3D), the housing 45A will now have its opposite side 62 exposed to the left anode 12. Thus, all sides and all interior surfaces will have been uniformly exposed to the electrolyte flow as well as current throw during each revolution of the magazine.

The path of a center 63 or equivalent reference point of housing 45A will be generally toroidal (see solid line path 65 of FIG. 4) for each revolution of the magazine and have a large convolute 65A and a small convolute 65B. If a housing is at the middle of the loading or series of housings, a reference point 64 will follow toroidal path 66 (see dashed line of FIG. 4) that will be shallower in profile (large convolute 66A and a small convolute 66B), but will experience a generally equal path length comparable to the toroidal path 65 of the housing 45A having a wider radial swing.

Figure 7:
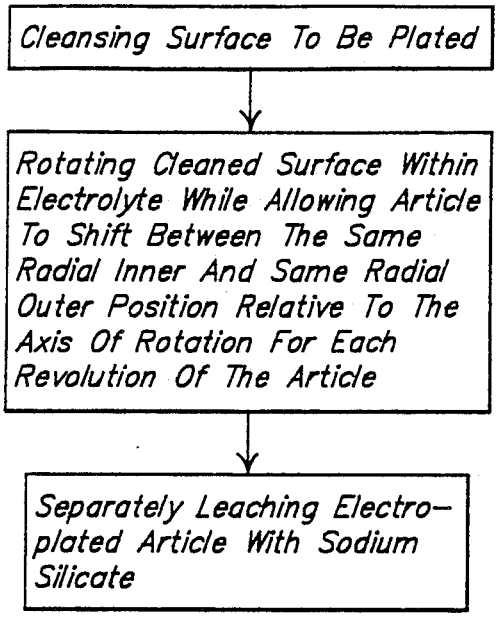
FIG. 7 is a block diagram illustrating the essential steps of the method aspect of this invention.
Figure 8:
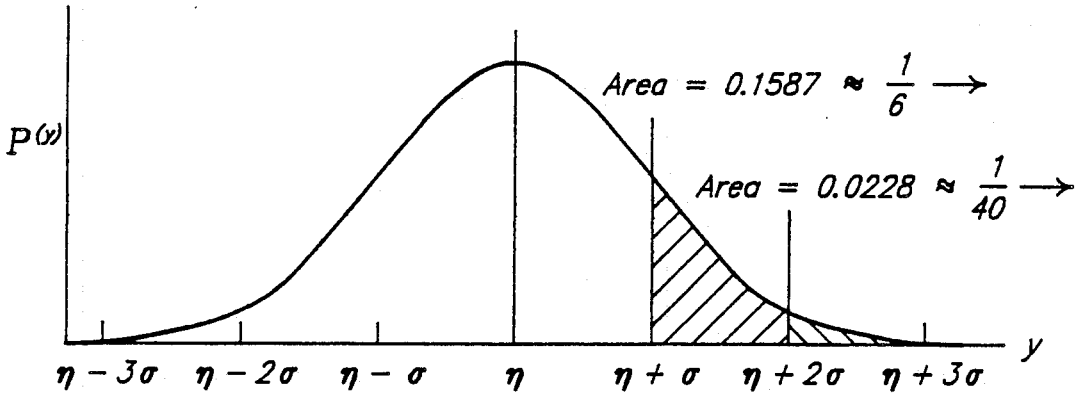

The method aspect of this invention essentially comprises three steps, as shown in FIG. 7. First, the article to be electroplated is cleansed at least with respect to the surface to be plated. This may be carried out by the use of a conventional alkaline cleansing solution for a period of about five minutes followed by double rinsing each for 45 seconds and then followed by a pickling wash with a 25% hydrochloric solution for a period of about three minutes, followed again by a double rinsing for 45 second periods.

The cleansed surface is then subjected to one or more electrolytic cells having sacrificial anodes and a galvanic field along a predetermined plane. This is carried out while rotating the article in the cell across the field while allowing the article to shift between a radially inner and radially outer position relative to the axis rotation during each revolution thereof. This results in a very thin, controlled uniform layer of zinc metal deposit, preferably in the range of 0.0003–0.0005 inches.

For purposes of corrosion resistance, the steel fuel injector housings of this preferred embodiment are first electroplated with a zinc metal. Various types of zinc plating baths may be employed and may include acid chloride baths, alkaline zinc baths, pyrophosphate baths, and cyanide baths. The most common zinc plating solution is that comprised of cyanide which commonly may contain 8–11 ounces per gallon of zinc cyanide (4.4–6.0 zinc metal equivalent), 5.2–8.8 ounces per gallon of sodium cyanide (11.9–18.0 total sodium cyanide), 10–12 ouncer per gallon of sodium hydroxide, and about 0.2 ounces per gallon of sodium polysulfide.

The tank or a spare tank is usually filled with water to about two-thirds of its volume. The caustic soda and sodium cyanide is dissolved first, then the zinc cyanide is gradually poured in and dissolved with constant agitation. While the bath is agitated, pure zinc may be added in an amount of about 1½ to 2 pounds per hundred gallons and agitation continued for about one hour, then agitation is stopped. The bath is allowed to stand about 4–6 hours, then is filtered into the prepared plating tank, leaving about 5% of the solution at the bottom which is discarded. At least three anodes are installed per lineal foot of anode rod and the bath is electrolytically purified at about 2–3 amps/ft$^2$ for a minimum of 24 hours, using as many cathodes as the plating tank can carry. The cyanide bath is then analyzed and corrected for the desired chemical composition using sodium cyanide and caustic soda only for this correction. The bath is subjected to an electrolytic cell with a power source of about 3 volts, with about 1.5 amps of current per part.

Next, the coated articles are subjected to electroplated chromate conversions using the same apparatus.

Advantageously, the electroplating may be carried out in the following sequence: first, zinc metal is applied for a period of about 45 minutes followed by double rinsing in water of 45 seconds, followed by a clear chromate plating step for a period of about 20 seconds followed by a rinse of clear water for about 35 seconds, and then finally di-chromate plating is accomplished for a period of about 40 seconds followed by rinsing in clear water for about 35 seconds.

To further enhance the corrosion resistance of such zinc and chromate deposits, the coated articles are then subjected to a leaching action with sodium silicate in a separate tank or operation.

Figure 8:
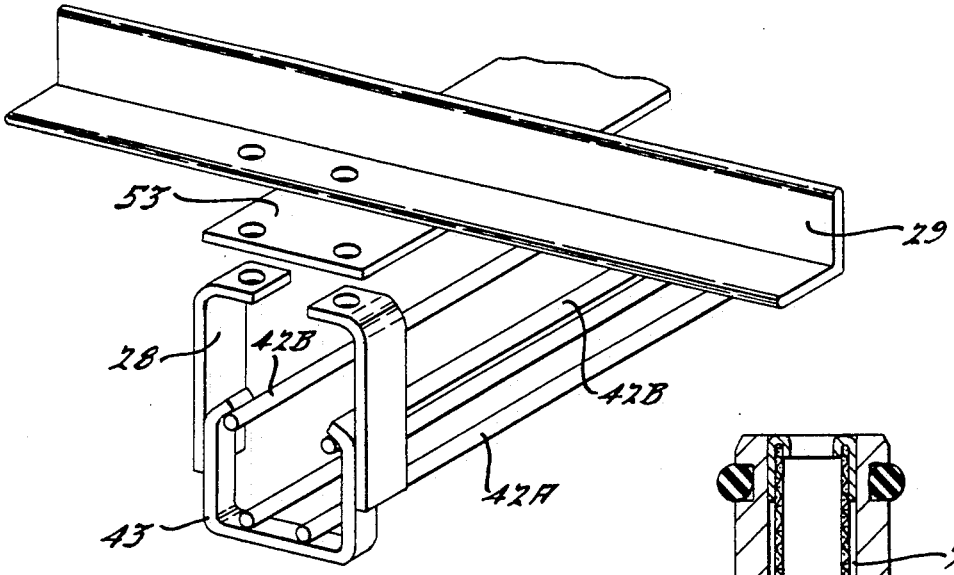
FIG. 8 is an illustration of a normality curve.

The method of this invention provides for an unusually robust normality; the probable variance of the coating quality from a normal distribution varies by about ±3 sigma. In manufacturing processes, quality distribution is often referred to as sigma. With reference to FIG. 8, the following characterize an appreciation of sigma:

1. The probability that a positive deviation from the mean will exceed one standard deviation is roughly one-sixth. This is the percentage of the total area under the curve in FIG. 8 within the shaded "tail" area.

2. Because of symmetry, this probability is exactly equal to the chance that a negative deviation from the mean will exceed one standard deviation.

3. Thus, the probability that a deviation in either direction will exceed one standard deviation is roughly one-third and consequently the probability of such a deviation less than one standard deviation is roughly two-thirds.

4. The chance that a positive deviation from the mean will exceed two standards deviations is roughly 1/40 and is represented by the heavily shaded tail area in FIG. 8. This is exactly to the chance that a negative deviation from the mean will exceed two standard deviations.

5. Thus, the chance that a deviation in either direction will exceed two standard deviations is roughly 1/20.

6. If the deviation is ±3 sigma, this means 99.8% of the time the population of the part being randomly tested will be within the specification limits.

This process achieves almost substantial normality, close to ±3 sigma, for a total sampling statistic of 6 sigma.

Figure 9:
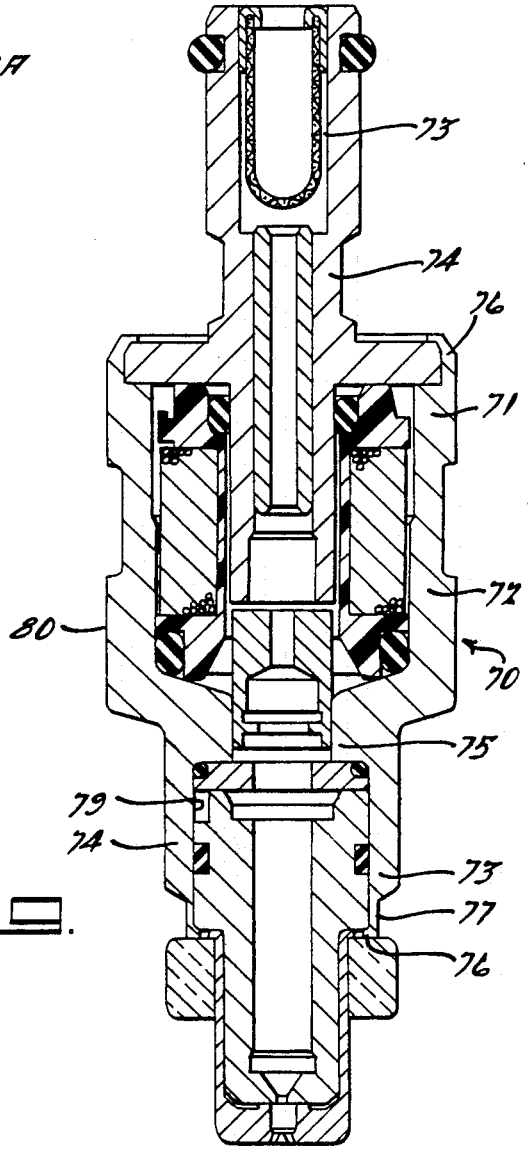
FIG. 9 is a greatly enlarged view of a flux permeable fuel injector housing representing an electroplated article of this invention.

An electroplated fuel injector housing produced by the above method can successfully withstand at least 96 hours of salt spray testing. As shown in FIG. 9, such fuel injection housing uniquely comprises: (a) a stepped steel tube 70, one end 71 of which is comprised of a barrel 72, the other end 73 of which is comprised of a reduced neck 74 and a throat 75 interconnecting such chest and neck, such throat being narrower than either of the barrel or neck; (b) deformable annular lips 76 along the exposed edges 77 of the neck and barrel; and (c) electrolytically deposited highly uniform layers 78 of zinc and chromate in a thickness of 0.0003–0.0005 inches along substantially all interior surfaces 79 and exterior surfaces 80 and in a thickness of 0.001–0.0005 inches along substantially exposed interior surfaces 79, such coating having been leached back by sodium silicate In practice, the thickness of the exterior and interior surfaces is substantially the same. After 96 hours of subjection to a salt spray test, the plated surfaces show no white salts or corrosion products, visible to the unaided eye at normal reading distance, at scratches through the dichromate to the zinc plate or at unscratched areas.

While particular embodiments of the invention have been illustrated and described, it will be obvious to those skilled in the art that various changes and modifications may be made without departing from the invention, and it is intended to cover in the appended claims all such modifications and equivalents as fall within the true spirit and scope of this invention.

What is claimed is:

1. A method of electroplating a precision hollow metal article with an anticorrosive film, comprising:

(a) cleaning a surface of said article to be plated;

(b) subjecting the cleansed surface to one or more electrolytic cells having sacrificial anodes and a galvanic field along a predetermined plane, by rotating said article in said cell across said field while allowing at least most of said articles to shift between a radially inner and a radially outer position relative to said axis during each revolution thereof; and (c) separately leaching said electroplated article with sodium silicate to further enhance the corrosion resistance of said coatings.

2. The method as in claim 1, in which in step (b) the electrolytic cell has zinc as an anode, and is followed by use of an immersion cell containing chromates.

3. The method as in claim 1, in which said shifting occurs during each one-half revolution of the magazine to promote electrolyte flow reversal.

4. The method as in claim 1, in which the coating thickness and uniformity varies within a statistical variation of $\pm 3$ sigma.

5. The method as in claim 1, in which the rotation of said articles stirs said electrolyte to improve coating quality.

6. An electroplated fuel injection housing that can successfully withstand at least 96 hours of a salt spray test, comprising:

(a) a stepped steel tube, one end of which is comprised of a barrel, the other end of which is comprised of a reduced neck, and a throat section joining said barrel and neck, which throat is narrower than either said barrel or neck;

(b) deformable annular lips along the exposed edges of said neck and chest; and (c) electrolytically deposited, highly uniform layers of zinc and chromate conversion layers on substantially all interior and exterior surfaces in a uniform thickness of 0.0003–0.0005 inches, which layers have been leached back by use of sodium silicate.

* * * * *